US007482991B2

(12) United States Patent
Boyle

(10) Patent No.: US 7,482,991 B2
(45) Date of Patent: Jan. 27, 2009

(54) MULTI-BAND COMPACT PIFA ANTENNA WITH MEANDERED SLOT(S)

(75) Inventor: Kevin Robert Boyle, Horsham (GB)

(73) Assignee: NXP B.V., Eindhoven (NL)

( * ) Notice: Subject to any disclaimer, the term of this patent is extended or adjusted under 35 U.S.C. 154(b) by 302 days.

(21) Appl. No.: 11/547,738

(22) PCT Filed: Apr. 1, 2005

(86) PCT No.: PCT/IB2005/051096

§ 371 (c)(1),
(2), (4) Date: Oct. 6, 2006

(87) PCT Pub. No.: WO2005/099041

PCT Pub. Date: Oct. 20, 2005

(65) Prior Publication Data

US 2007/0205947 A1 Sep. 6, 2007

(30) Foreign Application Priority Data

Apr. 6, 2004 (GB) ..... 0407901.8

(51) Int. Cl.
*H01Q 13/10* (2006.01)

(52) U.S. Cl. ..... 343/767

(58) Field of Classification Search ..... 343/767, 343/700 MS, 702, 846, 829
See application file for complete search history.

(56) References Cited

U.S. PATENT DOCUMENTS 5,231,407 A * 7/1993 McGirr et al. ..... 343/700 MS
6,061,024 A * 5/2000 McGirr et al. ..... 343/700 MS
6,856,294 B2 * 2/2005 Kadambi et al. ..... 343/702
6,954,180 B1 * 10/2005 Braun et al. ..... 343/702
7,015,868 B2 * 3/2006 Puente Baliarde et al. .. 343/800
7,202,822 B2 * 4/2007 Baliarda et al. ..... 343/700 MS
7,397,431 B2 * 7/2008 Baliarda et al. ..... 343/702
2001/0035843 A1 11/2001 Boyle
2003/0189522 A1 * 10/2003 Zeilinger ..... 343/702
2004/0140938 A1 * 7/2004 Kadambi et al. ..... 343/702
2004/0217916 A1 * 11/2004 Illera et al. ..... 343/895

* cited by examiner

*Primary Examiner*—Huedung Mancuso

(57) ABSTRACT

A planar antenna assembly comprises a Planar Inverted F Antenna mounted on a printed circuit board (PP) and comprising i) a radiating element (RE1, RE2) comprising first (RE1) and second (RE2) parts approximately perpendicular one to the other and being respectively located in a first plan facing and parallel to a ground plane mounted on a face of the printed circuit board (PP) and in a second plane perpendicular to said ground plane, ii) a feed tab (FT) extending from said second part (RE2) to said printed circuit board (PP), and iii) a main slot (SO1) having a chosen length and comprising a linear part (LP) defined in the second part (RE2) at a chosen location between lateral sides of the radiating element (RE1, RE2) and a meandered part (MP) extending the linear part (LP) into the first part (RE1). The second part (RE2) is arranged such that without the main slot (SO1) high and low frequency bands are equally capacitive and inductive respectively, and the length of the main slot (SO1) is such that it is electrically quarter-wave long at approximately the geometric mean of the low and high frequency bands.

15 Claims, 7 Drawing Sheets

MULTI-BAND COMPACT PIFA ANTENNA WITH MEANDERED SLOT(S)

FIELD OF THE INVENTION

The present invention relates to improvements in or relating to planar antennas, particularly, but not exclusively, to antennas for use in portable telephones. Such telephones may operate in accordance with the GSM and DCS 1800 standards.

PIFAs (Planar Inverted-F Antennas) are used widely in portable telephones because they exhibit low SAR (Specific Adsorption Ratio) which means that less transmitted energy is lost to the head and they are compact which enables them to be installed above the phone circuitry thereby using space within the phone housing more effectively. Such antennas are normally mounted on the back of the phone's plastic cover (or on an inner cover).

BACKGROUND OF THE INVENTION

As illustrated in FIG. 1 a typical dual-band PIFA has a radiating element RE connected to the phone printed circuit board (PCB) PP, which comprises a ground plane, through feed FT and shorting ST tabs (or pins). The radiating element RE also comprises a slot SO having approximately a U shape. Such an antenna is notably described in the patent document US 2001/0035843.

The SAR of such a dual-band PIFA can be simulated using a truncated flat phantom material layer PML and a skin layer SL such as the ones shown in FIG. 2. A flat phantom material layer PML is effectively considered to be more appropriate for comparative simulations than a curved alternative since a constant spacing is maintained between the phantom material layer and the PCB.

Examples of the relative dielectric constant and conductivity of the phantom PML and skin SL layers are given in the following Table 1 both for GSM and DCS standards.

TABLE 1

| | Phantom | | Skin | |
|---|---|---|---|---|
| Frequency Band | Relative dielectric constant $\epsilon_{pr}$ | Conductivity $\sigma_p$ (S/m) | Relative dielectric constant $\epsilon_{sr}$ | Conductivity $\sigma_s$ |
| GSM | 41.5 | 0.9 | 4.2 | 0.0042 |
| DCS | 40 | 1.4 | 4.2 | 0.00084 |

To minimise reflections at the truncation surfaces of the phantom material layer, these surfaces are defined as impedance boundaries, having the characteristic impedances of the dielectrics used. The characteristic impedance of a lossy dielectric is given by the following relation:

$$Z_0 = \sqrt{\frac{\mu}{\varepsilon - j\sigma/\omega}}$$

where $\mu$ is the magnetic permeability of the media, $\epsilon$ the electric permittivity of the media, $\sigma$ is the bulk conductivity, and $\omega$ is the angular frequency (i.e.=$2\pi$ times the frequency).

Using this relation, the characteristic impedances of the phantom PML and skin SL layers are given in the following Table 2 both for GSM and DCS standards.

TABLE 2

| Frequency (MHz) | Phantom impedance (Ω/square) | Skin impedance (Ω/square) |
|---|---|---|
| 900 | 54.35 + j12.06 | 183.83 |
| 1800 | 57.06 + j9.68 | |

An example of simulated SAR in the GSM (a) and DCS (b) bands is shown in FIG. 3. The SAR is sketched in W/kg and corresponds to an accepted power normalised to 1 W.

A known problem is that small dual-band PIFA antennas are required for diversity operation. Such antennas are narrowband, only operate over a limited number of bands, and exhibit high SAR compare with larger antennas (SAR is a local quantity).

SUMMARY OF THE INVENTION

So, the object of this invention is to improve the situation and more precisely to improve the bandwidth and/or the number of operation bands of compact PIFA antennas, while still allowing diversity reception to be achieved.

For this purpose, it provides a planar antenna assembly comprising a PIFA antenna mounted on a printed circuit board (PCB) and comprising:

- a radiating element comprising first and second parts approximately perpendicular one to the other and being respectively located in a first plan facing and parallel to a ground plane mounted on a face of the PCB and in a second plane perpendicular to the ground plane,
- a feed tab (or pin) extending from the second part to the PCB, and
- a main slot having a chosen length and comprising a linear part defined in the second part at a chosen location between the lateral sides of the radiating element and a meandered part extending the linear part into the first part,
- the second part being arranged such that without the main slot high and low frequency bands are equally capacitive and inductive respectively, and the length of the main slot being such that it is electrically quarter-wave long at approximately the geometric mean of the low and high frequency bands.

The planar antenna assembly according to the invention may include additional characteristics considered separately or combined, and notably:

- it offers at least a dual-resonance having frequencies defined at least by the chosen location of the main slot between the lateral sides of the radiating element. These resonance frequencies may be also defined by the length of the main slot;
- it may also comprise i) a shorting tab (or pin) extending from the second part to the printed circuit board between the feed tab and the linear part of the main slot, and ii) a differential meandered slot defined into the first and second parts of the radiating element between the feed and shorting tabs to introduce an additional resonance having a frequency determined by the length of the differential meandered slot;
- it may comprise a diplexer arranged to broaden at least one of the frequency bands. This diplexer may comprise a switched circuitry arranged for band selection;

it may offer a chosen nominal resistance defined by the location of the differential meandered slot between the chosen location of the main slot and one of the lateral sides of the radiating element;

the diplexer may comprise blocking filters for separating the bands. The diplexer may also comprise broadbanding parallel resonators for widening the antenna bandwidth and increasing the isolation;

in a variant the diplexer may comprise a phase rotating circuit. The diplexer may also comprise series resonant circuits for broadbanding;

the printed circuit board may comprise at least one notch arranged to introduce an additional band.

The invention also provides a communication apparatus (for instance a portable telephone) and a radio frequency (RF) module comprising at least one planar antenna assembly such as the one above introduced.

BRIEF DESCRIPTION OF THE DRAWINGS

Other features and advantages of the invention will become apparent on examining the detailed specifications hereafter and the appended drawings, wherein.

The appended drawings may not only serve to complete the invention, but also to contribute to its definition, if need be.

DESCRIPTION OF PREFERRED EMBODIMENTS

Figure 1:
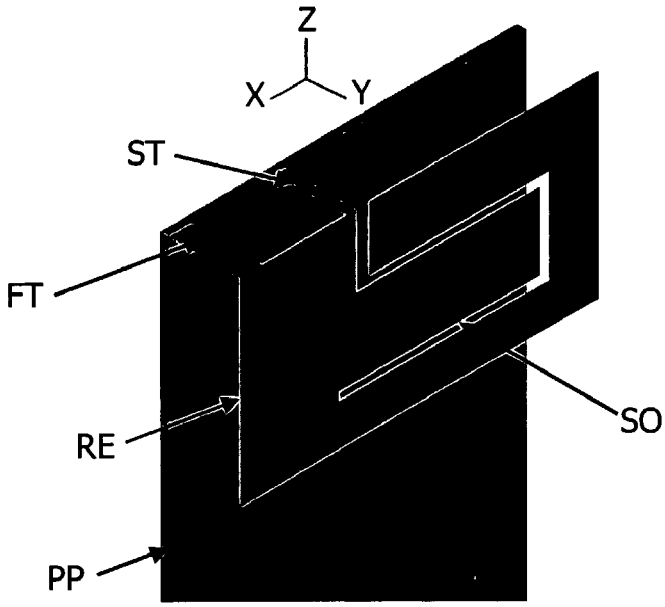
FIG. 1 schematically illustrates a conventional dual-band PIFA.
Figure 2:
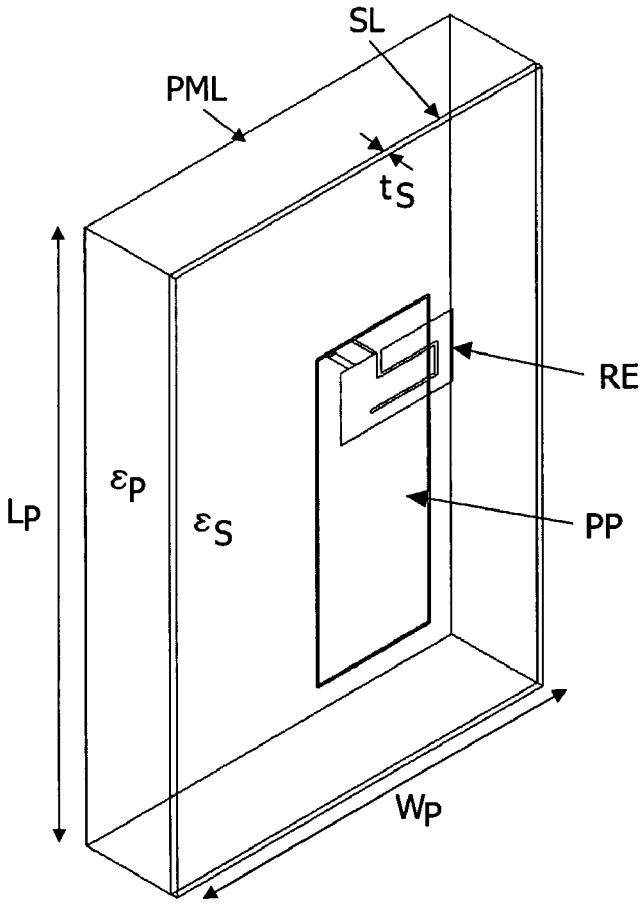
FIG. 2 schematically illustrates a dual-band PIFA simulation with a truncated flat phantom material layer and a skin layer.
Figure 3A:
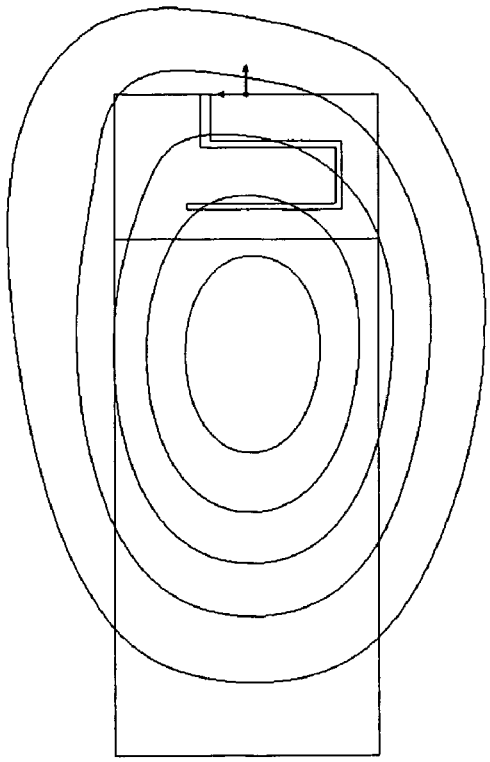
FIG. 3 illustrates simulated SAR diagrams of a conventional dual-band PIFA in the GSM (a) and DCS (b) bands, FIG. 4 schematically illustrates a first example of embodiment of PIFA antenna with a highly meandered dual-banding slot according to the invention.
Figure 3B:
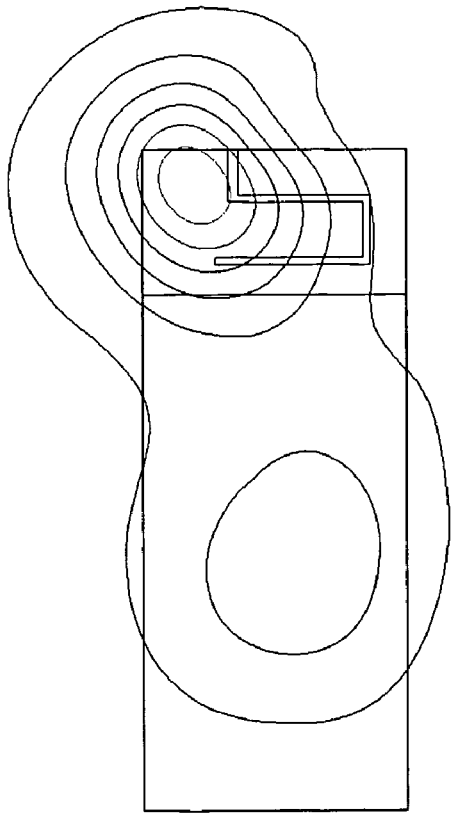
Figure 4:
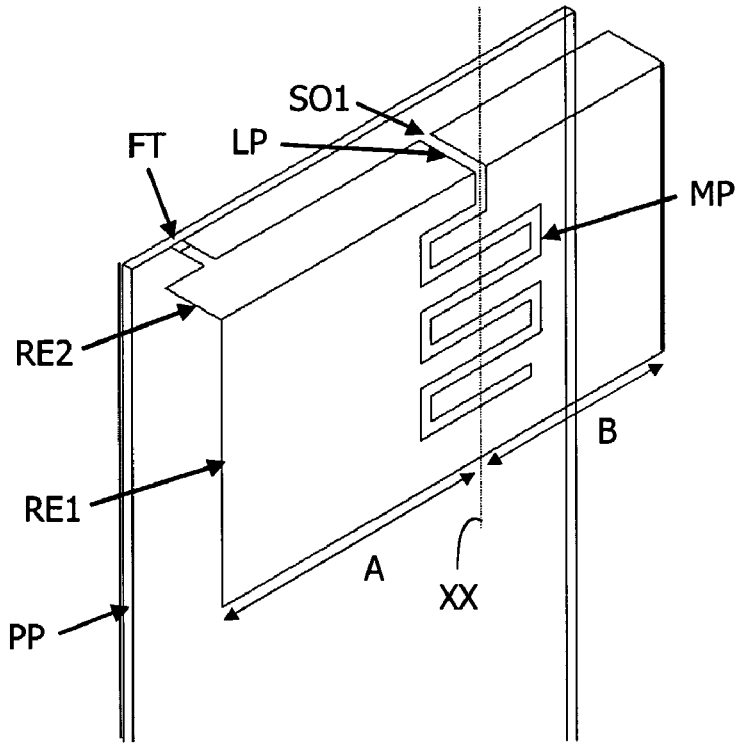

The invention proposes to mount a compact PIFA antenna assembly having at least one meandered slot in the space within a mobile phone normally previously occupied by a larger antenna. A first example of embodiment of such a PIFA antenna is illustrated in FIG. 4.

The compact antenna assembly, according to the invention, comprises a PIFA antenna mounted on a printed circuit board (PCB) PP. The PIFA antenna comprises a radiating element RE1, RE2, a feed tab (or pin) FT and a (dual-banding) main slot SO1 defined in the radiating element RE1, RE2.

The radiating element comprises first RE1 and second RE2 parts approximately perpendicular one to the other and having preferably approximately a rectangular shape. The first part RE1 is located in a first plan facing and parallel to a ground plane mounted on a face of the printed circuit board (PCB) PP. The second part (or top plate) RE2 is located in a second plane perpendicular to the ground plane.

The feed tab FT extends from the second part RE2 of the (dual-banding) main slot SO1 to the PCB PP.

The main slot SO1 has a chosen length and comprises a linear part LP defined in the second part RE2 of the radiating element at a chosen location between its lateral sides and a meandered part MP extending the linear part LP into the first part RE1 of the radiating element.

In FIG. 4 the chosen location of the main slot linear part LP is materialized by the axis XX which is separated from the two lateral sides by distances A and B, whose ratio A/B may be varied in order the resonance occurs at desired frequencies (some minor adjustment in the length of the main slot SO1 may also be done).

The second part RE2 is arranged such that without the (dual-banding) main slot SO1 high and low frequency bands are equally capacitive and inductive respectively. Moreover the length of the main slot SO1 is such that it is electrically quarter-wave long at approximately the geometric mean of the low and high frequency bands.

Figure 5:
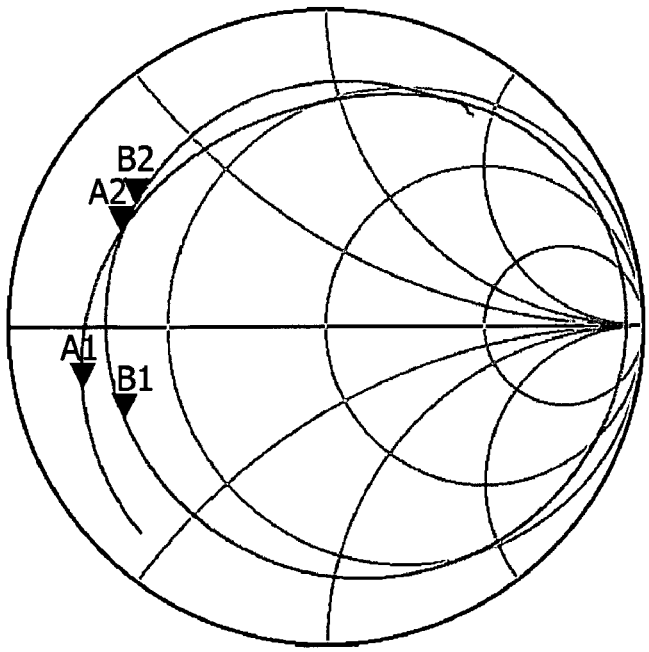
FIG. 5 illustrates the $S_{11}$ factor of the PIFA antenna shown in FIG. 4, FIG. 6 schematically illustrates a second example of embodiment of PIFA antenna with two highly meandered slots according to the invention.

The simulated $S_{11}$ factor of the antenna assembly illustrated in FIG. 4 is shown in FIG. 5 (marker A1 materializes 880 MHz, marker A2 materializes 960 MHz, marker B1 materializes 1710 MHz and marker B2 materializes 1880 MHz).

From the $S_{11}$ curve, it can be seen that a dual-resonance is achieved. Therefore the antenna assembly example shown in FIG. 4 is adapted for dual-banding.

Figure 6:
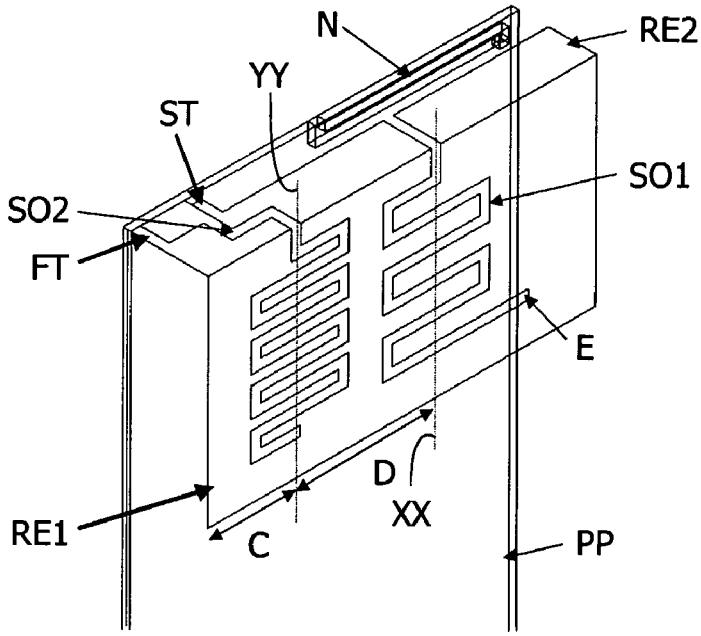

In order to introduce an additional resonance, the antenna assembly may further comprise a shorting tab ST and a differential meandered slot SO2. Such an arrangement is shown in FIG. 6.

As it is illustrated, the shorting tab ST extends from the second part RE2 of the radiating element to the printed circuit board PP between the feed tab FT and the linear part LP of the main slot SO2.

The differential meandered slot SO2 is defined into the first RE1 and second RE2 parts of the radiating element between the feed FT and shorting ST tabs to introduce the additional resonance. The frequency of this additional resonance is determined by the length of the differential meandered slot SO2.

This differential meandered slot SO2 allows the series resonant nature of the PIFA and handset PCB/case to be maintained. It also allows the additional resonance to be introduced without compromising the existing resonances.

As illustrated in FIG. 6 the extremity E of the dual-banding main slot SO1 may be altered to give resonance at slightly different frequencies.

Figure 7:
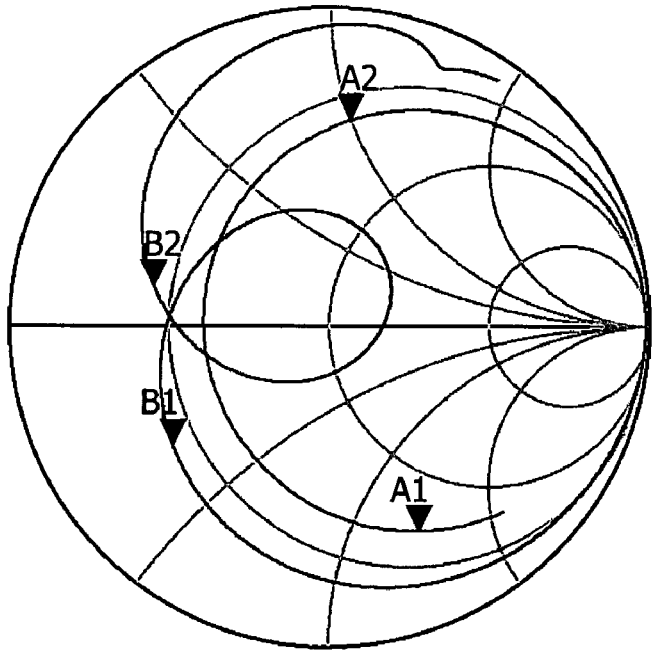
FIG. 7 illustrates the $S_{11}$ factor of the PIFA antenna shown in FIG. 6, FIG. 8-1 and FIG. 8-2 illustrate a diplexer for broadbanding a PIFA antenna such as the one shown in FIG. 7.

The simulated $S_{11}$ factor of the antenna assembly illustrated in FIG. 6 is shown in FIG. 7 (marker A1 materializes 824 MHz, marker A2 materializes 960 MHz, marker B1 materializes 1710 MHz and marker B2 materializes 2170 MHz).

From the $S_{11}$ curve, it can be seen that the differential meandered slot SO2 introduces an additional resonance in the high frequency band, the frequency of which is determined by the length of the differential meandered slot.

As illustrated in FIG. 6 a notch N may be added in the PCB PP below the PIFA for coverage of Bluetooth/WiFi band.

Also, the impedance may be transformed dependent on the length of the differential meandered slot SO2 and its position (location) between the chosen location XX of the main slot SO1 and one of the lateral sides of the radiating element RE1, RE2.

In FIG. 6 the location of the differential meandered slot SO2 is materialized by the axis YY, which is separated from the nearest lateral side of the radiating element by a distance C and from location XX by a distance D. The nominal resistance of the antenna assembly can easily be varied by changing the ratio C/D.

Figures 1, 8:
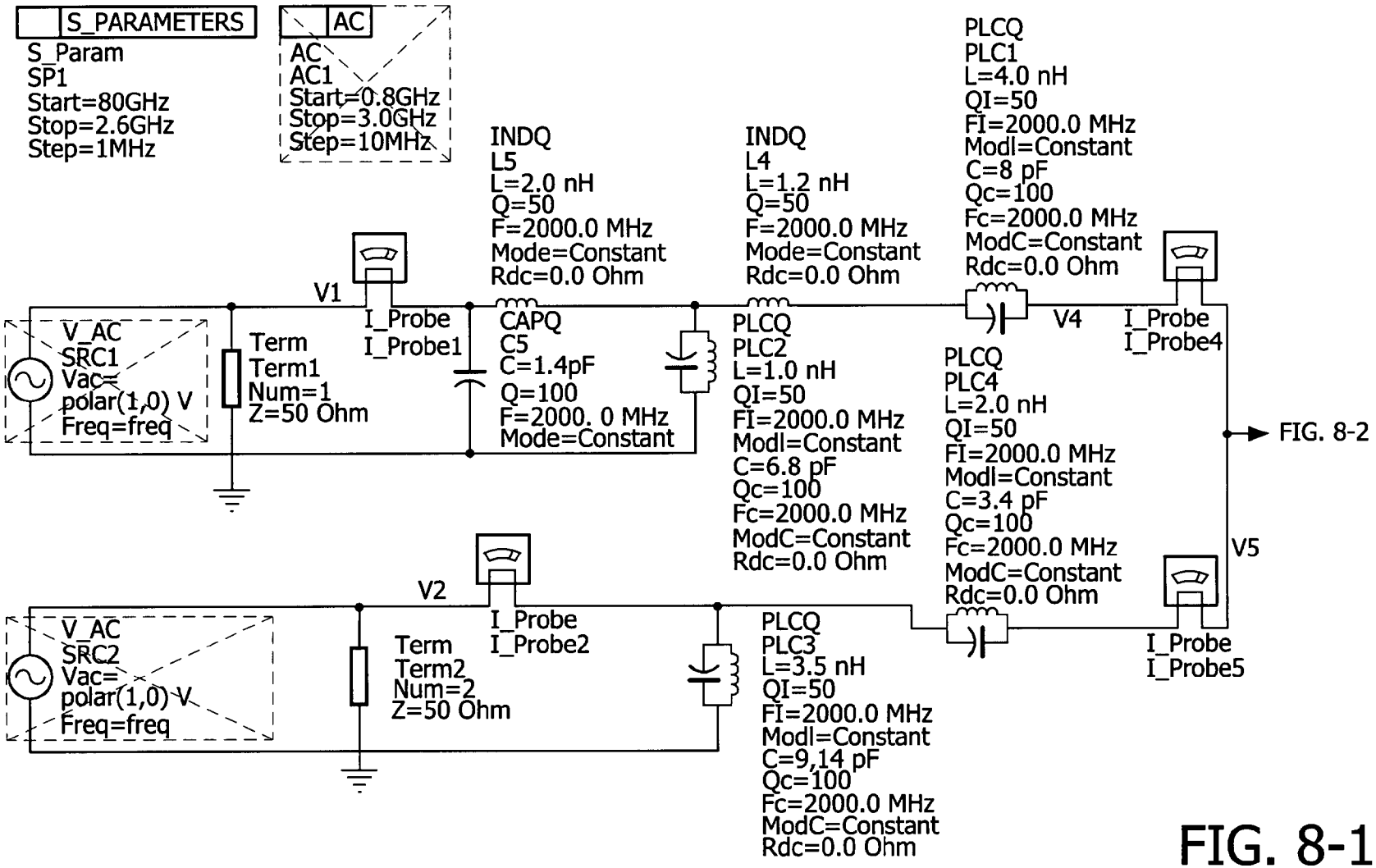
Figures 2, 8:
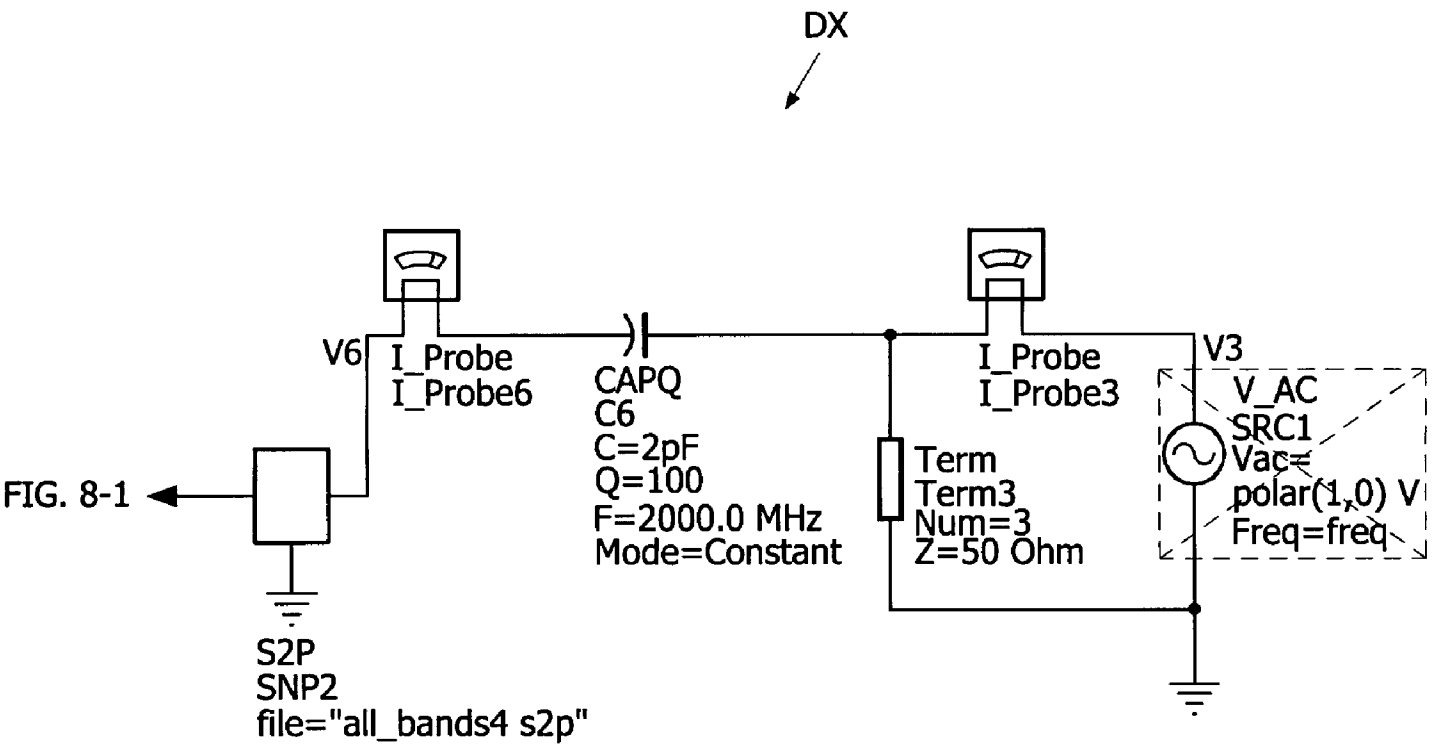
Figure 9:
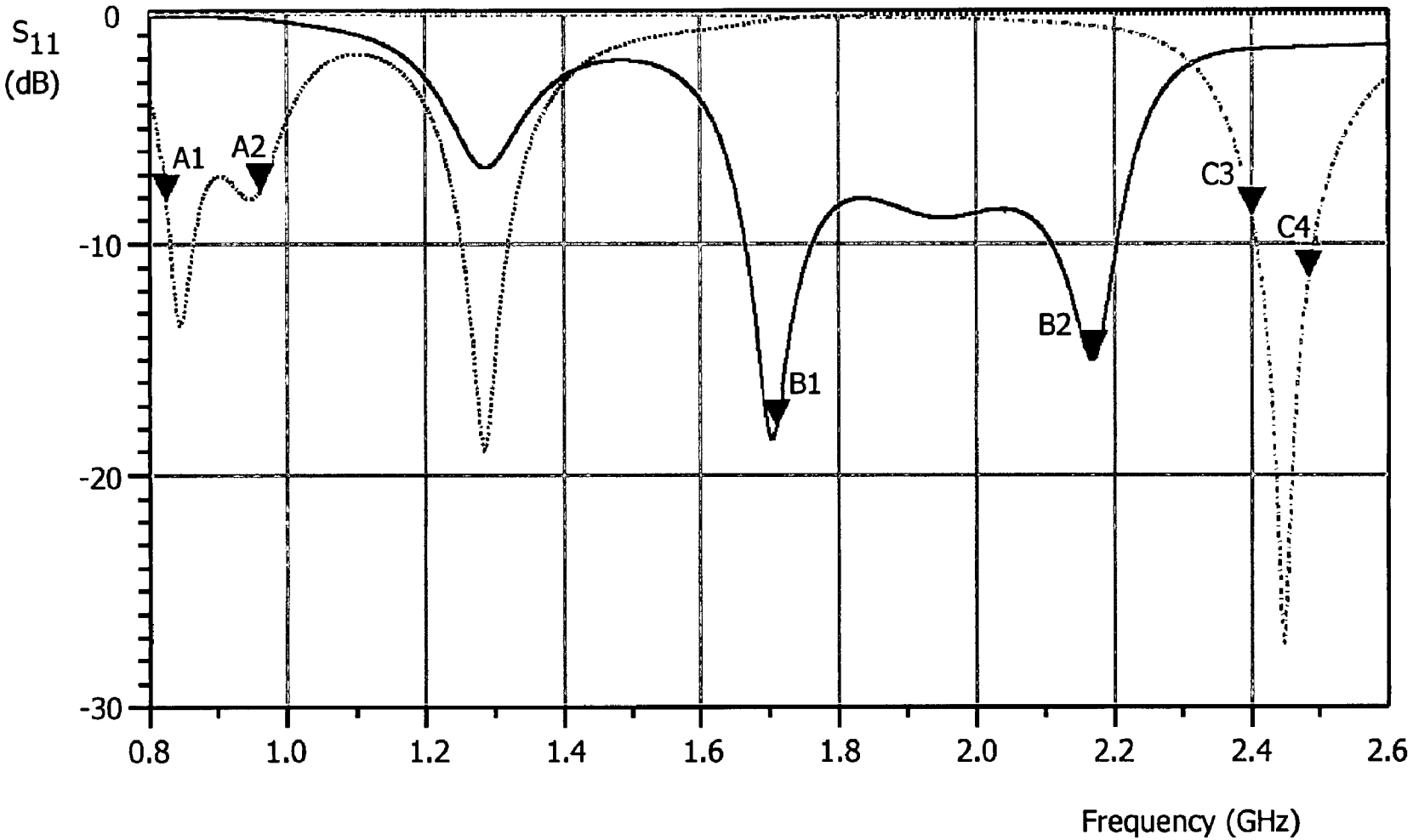
FIG. 9 illustrates the $S_{11}$ factor of the PIFA antenna shown in FIG. 6 and coupled to the diplexer shown in FIG. 8.

The differential meandered slot SO2 used to provide the additional resonance may also be used to provide impedance control. So, a diplexer can be coupled to the compact PIFA antenna to broaden at least one of the frequency bands. FIG. 8 shows a non limiting example of diplexer DX that can perform this broadbanding function.

This diplexer DX may comprise a switched circuitry arranged for band selection.

FIG. 8 shows the SI, factor of the antenna assembly illustrated in FIG. 6 and coupled to the diplexer DX shown in FIG. 7 (marker A1 materializes 824 MHz, marker A2 materializes 960 MHz, marker B1 materializes 1710 MHz, marker B2 materializes 2170 MHz, marker C1 materializes 2400 MHz, and marker C2 materializes 2483 MHz) at the input of the multiplexing network.

It can be seen from the $S_{11}$ curve that the AMPS, GSM, DCS, PCS, UMTS and Bluetooth/WiFi bands can be covered in this way. GPS and 5 GHz WLAN frequencies may also be covered with additional notches at the top of the PCB/module (this is the best place for such antennas in order to avoid user interaction).

The diplexer DX maintains the series resonant characteristic of the antenna, since series connected blocking filters may be used to separate the bands. Moreover broadbanding parallel resonators may be used to widen the antenna bandwidth and increase the isolation. Alternatively, phase rotating circuitry may be used to perform the diplexing function such that series resonant circuits may be used for broadbanding (for example, a high-pass, low pass diplexer may be used).

The second example of embodiment offers an easily adjustable antenna assembly design with two highly meandered slots. This antenna assembly is predominantly series resonant in both bands and can therefore be broadbanded by complementary parallel resonant circuits, after diplexing. The antenna has a low impedance for optimum performance when user interaction is present, as discussed in the applicants pending UK patent application no. 0319211.9 filed 15 Aug. 2003.

By maintaining a series resonant antenna impedance it is a simple matter to tune the resonant frequency by switching. On the AMPS/GSM side of the diplexer, for example, a series inductor can be switched into the circuit to improve the AMPS performance. Similarly, for a phase rotating diplexer shunt connected switching can be performed.

The Bluetooth notch is self-isolating from the cellular antenna. In all cases the isolation is better than −15 dB.

The compact PIFA antenna according to the invention may be mounted inside a mobile phone. It is adapted for achieving multi-band operation. Multiple resonances can be achieved using highly meandered slots. The antenna performance can be easily predicted based on the length and position of the meandered slot(s). The slot(s) also allow(s) the antenna to retain a predominantly series resonant characteristic, which allows to couple it to a diplexer that can bandwidth broaden the antenna and then to achieve an easy frequency band tuning. It is capable of switched operation at both GSM and DCS/PCS/UMTS and eventually Bluetooth and/or WiFi and/or GPS and/or 5 GHz WLAN. It also has low SAR due to the shielding effect of the PCB.

The invention is not limited to the embodiments of planar antenna assembly (PIFA antenna) and communication apparatus (mobile phone) described above, only as examples, but it encompasses all alternative embodiments which may be considered by one skilled in the art within the scope of the claims hereafter.

In the present specification and claims the word "a" or "an" preceding an element does not exclude the presence of a plurality of such elements. Further, the word "comprising" does not exclude the presence of other elements or steps than those listed.

The invention claimed is:

1. A planar antenna assembly, characterized in that it comprises a Planar Inverted F Antenna mounted on a printed circuit board and comprising i) a radiating element comprising first and second parts approximately perpendicular one to the other and being respectively located in a first plan facing and parallel to a ground plane mounted on a face of said printed circuit board and in a second plane perpendicular to said ground plane, ii) a feed tab extending from said second part to said printed circuit board and iii) a main slot having a chosen length and comprising a linear part defined in said second part at a chosen location between lateral sides of said radiating element and a meandered part extending said linear part into said first part, said second part being arranged such that without said main slot high and low frequency bands are equally capacitive and inductive respectively, and the length of said main slot being such that it is electrically quarter-wave long at approximately the geometric mean of said low and high frequency bands.

2. A planar antenna assembly according to claim 1, characterized in that said first part and said second part have approximately rectangular shapes.

3. A planar antenna assembly according to claim 1, characterized in that it offers at least a dual-resonance having frequencies defined at least by the chosen location of said main slot between said lateral sides of said radiating element.

4. A planar antenna assembly according to claim 3, characterized in that said resonance frequencies are also defined by said main slot length.

5. A planar antenna assembly according to claim 1, characterized in that it also comprises i) a shorting tab extending from said second part to said printed circuit board between said feed tab and said linear part of said main slot and ii) a differential meandered slot defined into said first and second parts of said radiating element between said feed and shorting tabs to introduce an additional resonance having a frequency determined by the length of said differential meandered slot.

6. A planar antenna assembly according to claim 5, characterized in that it comprises a diplexer arranged to broaden at least one of said frequency bands.

7. A planar antenna assembly according to claim 6, characterized in that said diplexer comprises a switched circuitry arranged for band selection.

8. A planar antenna assembly according to claim 5, characterized in that it offers a chosen nominal resistance defined by the location of said differential meandered slot between the chosen location of said main slot (Sol) and one of said lateral sides of said radiating element.

9. A planar antenna assembly according to claim 6, characterized in that said diplexer comprises blocking filters for separating the bands.

10. A planar antenna assembly according to claim 9, characterized in that said diplexer comprises broadbanding parallel resonators for widening the antenna bandwidth and increasing the isolation.

11. A planar antenna assembly according to claim 6, characterized in that said diplexer comprises a phase rotating circuit.

12. A planar antenna assembly according to claim 11, characterized in that said diplexer comprises series resonant circuits for broadbanding.

13. A planar antenna assembly according to claim 5, characterized in that said printed circuit board comprises at least one notch arranged to introduce an additional band.

14. A communication apparatus, characterized in that it comprises at least one planar antenna assembly according to claim 1.

15. A RF module, characterized in that it comprises at least one planar antenna assembly according to claim 1.

* * * * *